US005697814A

United States Patent [19]

Delaunay

[11] Patent Number: 5,697,814

[45] Date of Patent: Dec. 16, 1997

[54] ELECTRICAL CONNECTOR

[75] Inventor: Pascal Delaunay, Montigny Le Bretonneux, France

[73] Assignee: Connecteurs Cinch, Societe Anonyme, Montigny Le Bretonneux, France

[21] Appl. No.: 548,554

[22] Filed: Oct. 26, 1995

[30] Foreign Application Priority Data

Nov. 21, 1994 [FR] France ..... 94 13903

[51] Int. Cl.[6] ..... H01R 13/40

[52] U.S. Cl. ..... 439/595; 439/752

[58] Field of Search ..... 439/290, 291, 439/595, 596, 293, 295, 752

[56] References Cited

U.S. PATENT DOCUMENTS

| | | | |
|---|---|---|---|
| 4,797,116 | 1/1989 | Isohata et al. | 439/595 |
| 5,066,252 | 11/1991 | Kato et al. | 439/752 |
| 5,071,373 | 12/1991 | Nagasaka et al. | 439/595 |
| 5,203,722 | 4/1993 | Kinoshita | 439/595 |
| 5,397,249 | 3/1995 | Endo et al. | 439/595 |

FOREIGN PATENT DOCUMENTS 4123505 1/1993 Germany .

OTHER PUBLICATIONS

French Search Report.

*Primary Examiner*—Neil Abrams
*Assistant Examiner*—Barry Matthew L. Standig
*Attorney, Agent, or Firm*—Greenblum & Bernstein P.L.C.

[57] ABSTRACT

An electric connector includes a female housing member and a male housing member and each housing member includes an arrangement for receiving a locking key able to assume two positions. These are a waiting position allowing insertion of the members and a locked position in which the locking keys lock the members. Each locking key includes means for opposing insertion of the male housing member into the female housing member when it is in the waiting position.

7 Claims, 15 Drawing Sheets

ELECTRICAL CONNECTOR

BACKGROUND OF INVENTION

1. Field of the Invention

The present invention concerns an electrical connector.

2. Description of the Prior Art

The invention concerns electrical connectors comprising a male housing member adapted to be inserted into a female housing member, each housing member comprising passages adapted to receive complementary electric contact members.

The passages include lugs for locking the electric contact members and said housing members are provided with locking keys that are adapted to immobilize the locking lugs.

The aim of the invention is to improve these connectors by preventing the housing members being assembled together if the electric contact members are not correctly inserted into the passages.

SUMMARY OF THE INVENTION

The invention consists in an electrical connector comprising a female housing member including a series of passages each adapted to receive an electric contact member, a male housing member adapted to be inserted in the female housing member and including a series of passages each adapted to receive an electric contact member complementary to those of the female housing member, means for assembling the housing members together, each housing member having, in each passage, an elastic locking lug featuring a projection adapted to cooperate with an opening in the corresponding electric contact member and each housing member including, at the end adapted to cooperate with the corresponding end of the other housing, means for receiving a locking key mounted to slide perpendicularly to the passages and adapted to occupy either of two positions, namely a waiting position in which the elastic locking lugs can move freely to enable mounting of electric contact members and a locked position in which the locking keys immobilize the elastic locking lugs, each locking key including means for opposing insertion of the male housing member into the female housing member if the latter is in the waiting position, in which electrical connector each locking key is a frame within which extend a series of parallel strips adapted to be inserted between the passages of the housing members transversely to the latter and which have a face with bevels separated by abutments so that in the waiting position of the key the bevels are in line with the locking lugs to enable the latter to move freely whereas in the locking position the abutments are in line with the locking lugs to lock them.

In accordance with one design feature, each locking key of one housing member includes a strip projecting towards the other housing member, the strips being disposed so that in the locking position of the keys they slide against each other.

In accordance with another feature, the strip of the locking key of the male housing member is so disposed in that the waiting position of the key it abuts against the free end of the female housing member whereas when it is in the locked position but the locking key of the female housing member is in the waiting position, it abuts against the free end of the strip of the locking key of the female housing member.

In accordance with one design feature, each housing member includes hooks for fixing corresponding locking keys, mounted to slide between the hooks and including, on two opposite sides, protuberances adapted to cooperate selectively with pairs of notches in order to be retained in the two positions.

The electrical connector of the invention is adapted to be used with electric contact members that include a lateral opening, each locking key having lugs adapted to be inserted into lateral openings in the locking position of the keys. This achieves two-fold locking of the electric contact members and additionally the keys cannot be placed in the locking position if the members are not correctly inserted in the passages.

In accordance with one design feature, the lugs are disposed on a face of the strips opposite that provided with the bevels and the abutments and the lateral opening of the electrical contact members is on the side of a face thereof opposite that with the opening adapted to receive the projection on the elastic locking finger.

The female housing member preferably has means for fixing it into an opening in a wall, the electric contact members being hermaphroditic.

The invention will now be described in more detail and by way of example only with reference to a specific embodiment shown in the appended drawings.

DETAILED DESCRIPTION OF THE PREFERRED EMBODIMENT

Figure 1:
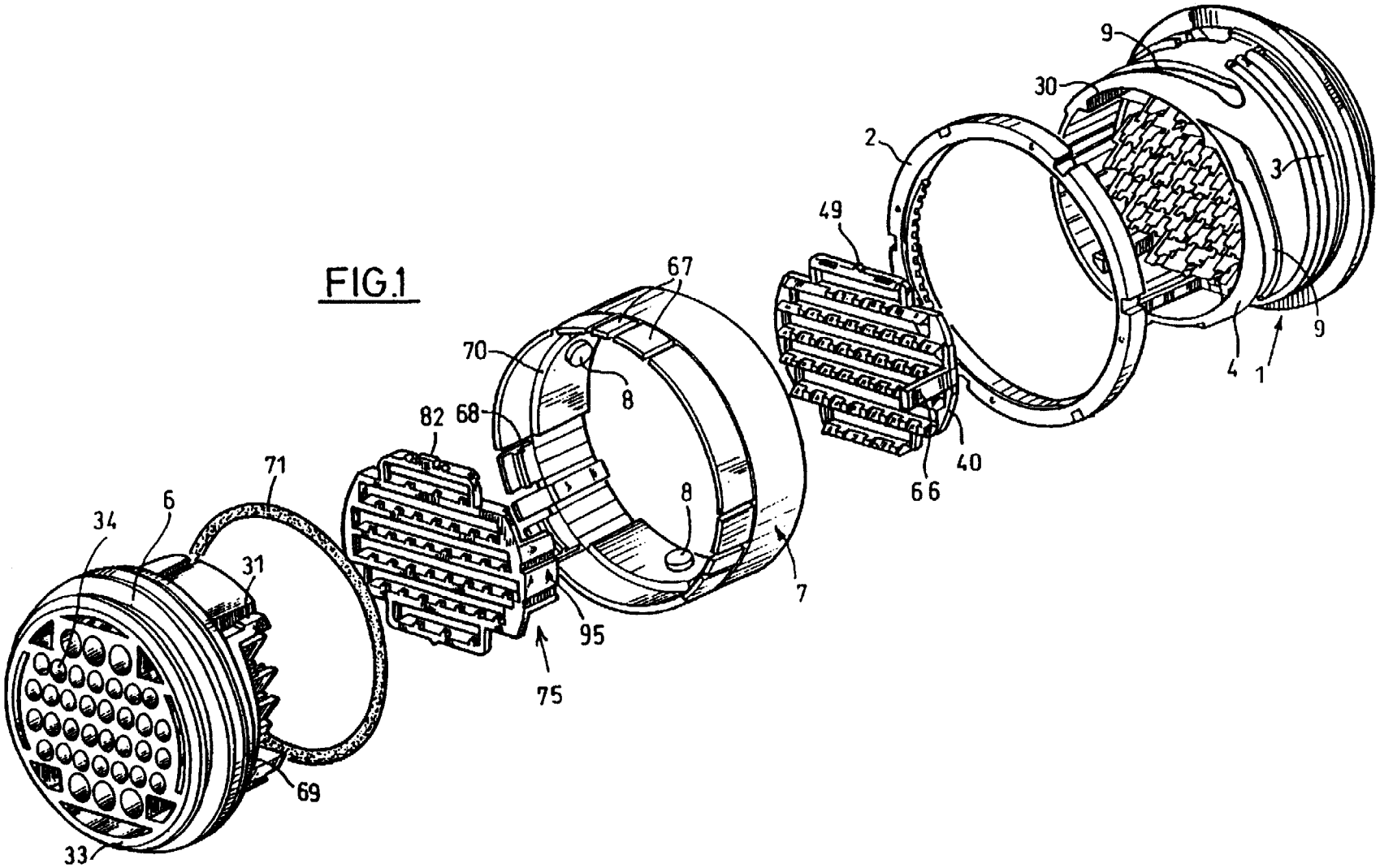
FIG. 1 is an exploded perspective view of a connector in accordance with the invention.

The connector shown in the figures has a female first housing member 1 adapted to be fixed into an opening in a wall by means of a screwthreaded ring 2 adapted to cooperate with a screwthread 3 on a skirt 4 of said member 1.

The member 1 is adapted to receive a male member 6 on which is mounted a coupling ring 7 that can turn and has lugs 8 on the inside adapted to cooperate with ramps 9 on the lateral surface of the skirt 4.

The housing member 1 includes a series of passages 10 open at a rear end 11 and ending in a bevel at the other end; near this bevel, the bottom of each passage includes a cut-out locking lug 15 featuring a projection 16 with a ramp 16*a* on the side facing the rear end and a step 16*b* on the opposite side.

Figure 2:
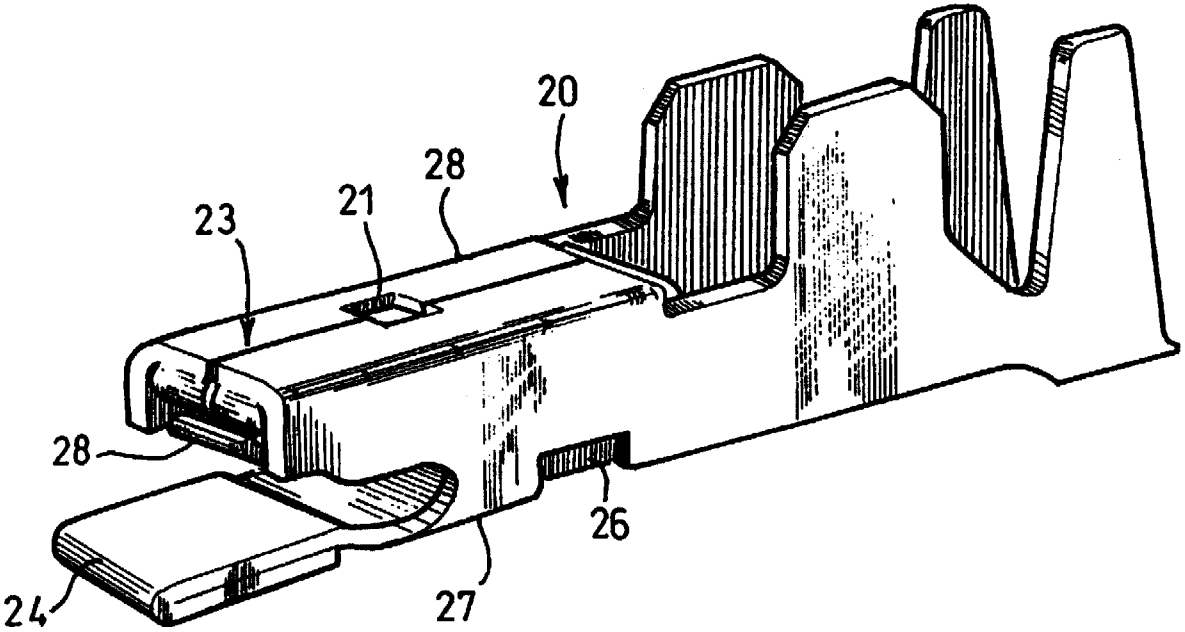
FIG. 2 is a perspective view of a hermaphroditic contact member to be used in a connector of the invention.

In this embodiment each passage 10 is adapted to receive a hermaphroditic contact member 20 (see FIG. 2) having a floor wall 23 with an opening 21. The opposite wall 27 forms a male tongue 24 and has a lateral opening 26. An elastic tongue 28 extends between the walls 23 and 27.

Figure 3:
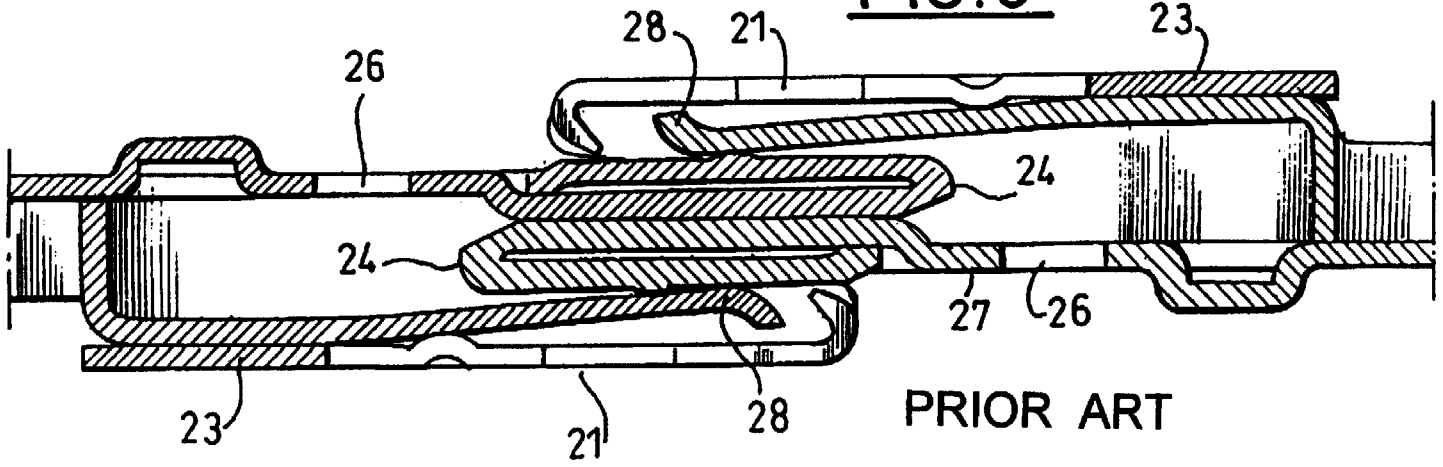
FIG.3 PRIOR ART
FIG. 3 shows two hermaphroditic contact members assembled together in longitudinal section.
Figure 4:
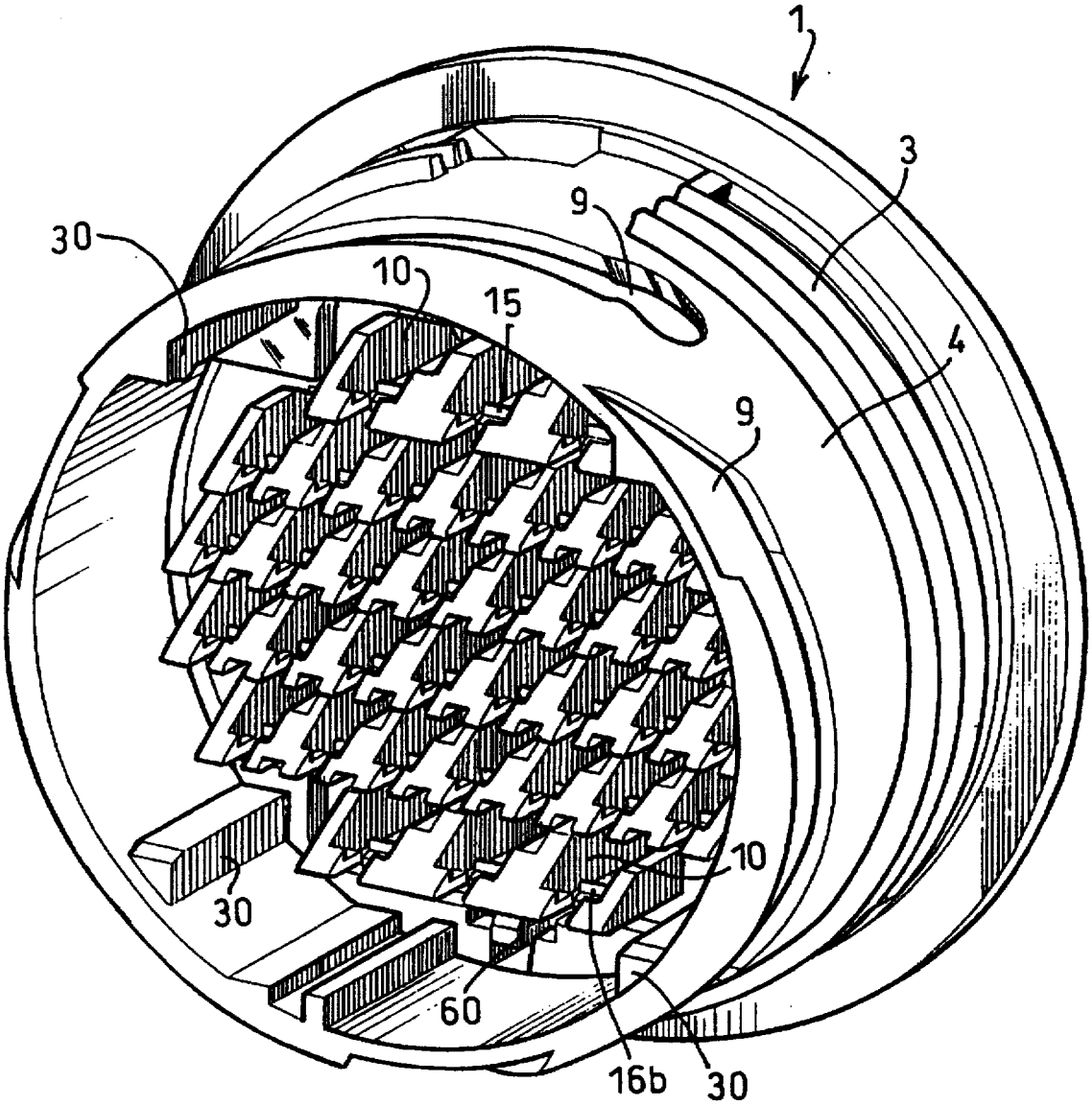
FIG. 4 is a perspective view to a larger scale of the female housing member of the connector.

As shown in FIG. 3, the contact members 20 are adapted to be fitted together head-to-tail and with one inverted relative to the other, the male tongue 24 of one being inserted between the male tongue 24 and the elastic tongue 28 of the other.

Each contact member 20 is inserted into a passage 10 so that the corresponding projection 16 is inserted in the opening 21 to lock said member.

The skirt 4 has ribs 30 on its inside face adapted to guide the male member 6, the part of which that is inserted in said skirt 4 being provided with grooves 31. The grooves 31 and the ribs 30 constitute a polarizer so that the male member 6 can be mounted in the female member 1 in only one angular position.

Figure 8:
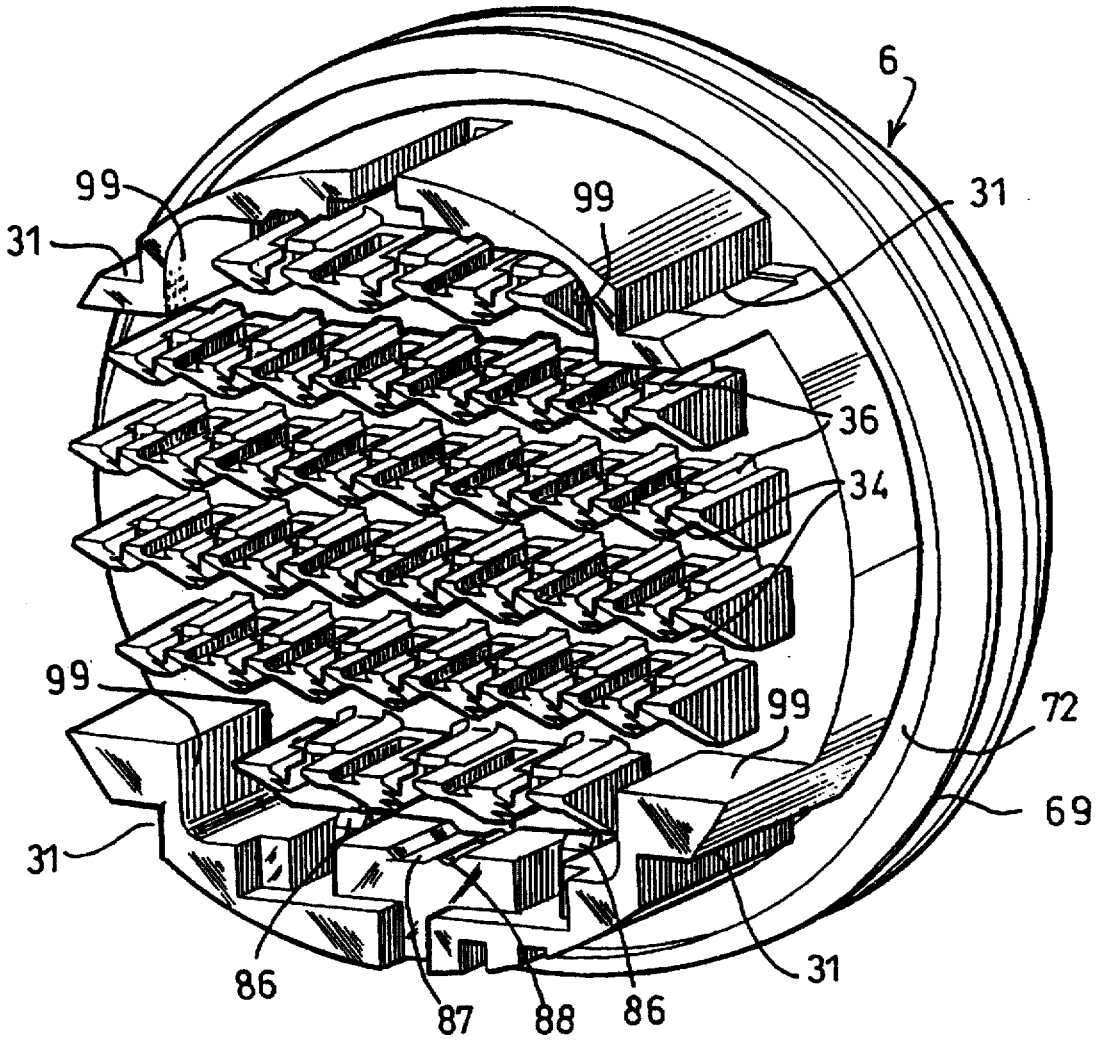
FIG. 8 is a perspective view of the male housing member.
Figure 9:
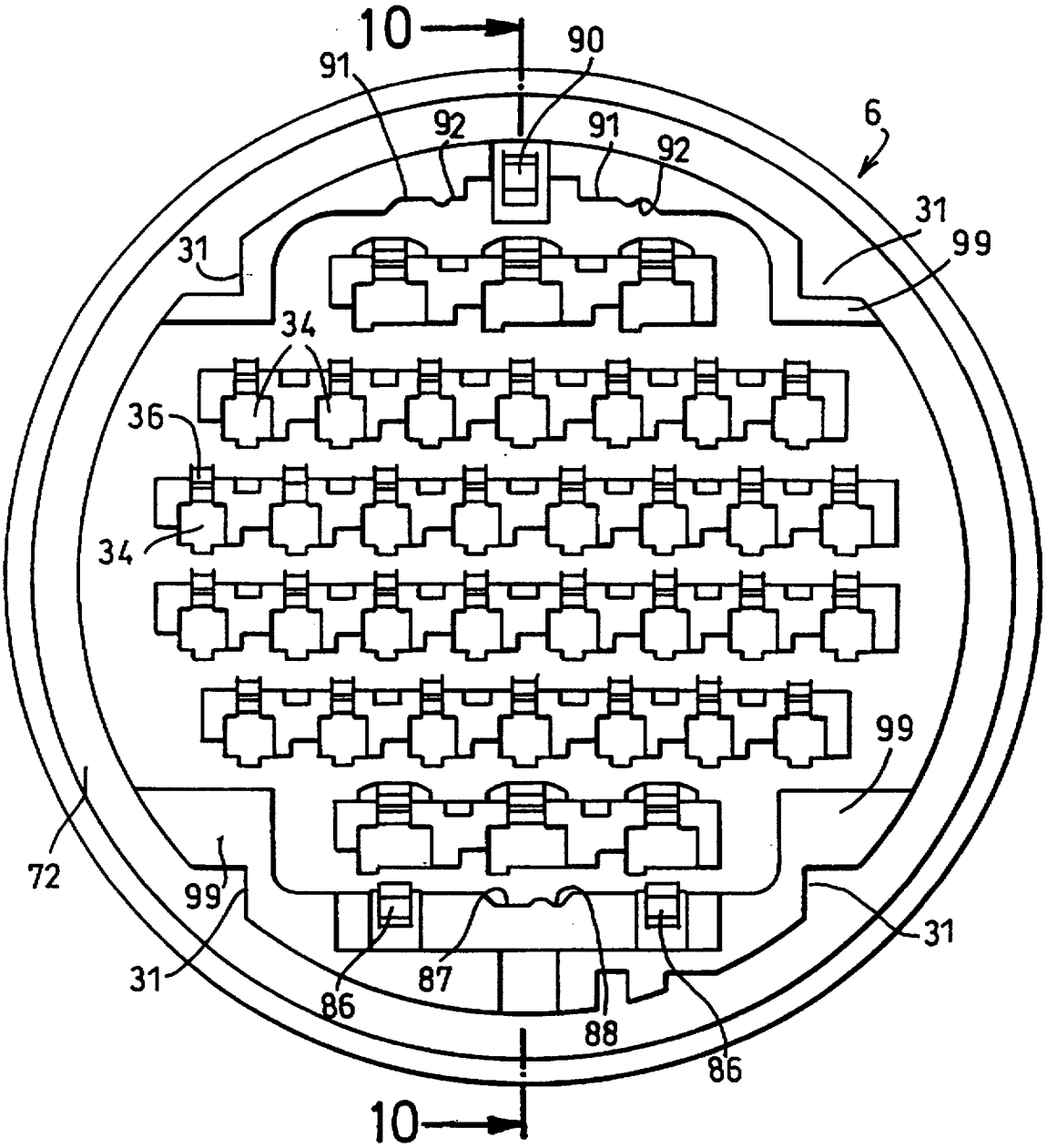
FIG. 9 is a plan view of the male housing member.

A series of passages 34 in the male member 6 correspond to the passages 10 and are open at a rear end 33. Their opposite ends terminate at bevels rotated 180° relative to the bevels on the female member 1 so that they coincide with the latter. Each passage 34 includes a locking lug 36 offset 180° relative to the lugs 15 and featuring a projection 37 having a ramp 37*a* on the side towards the rear end 33 and a step 37*b* on the opposite side (see FIGS. 8–10).

Each passage 34 is adapted to receive a contact member 20 that is locked by the lug 36, the projection 37 on which is engaged in the opening 21. The members 20 of the passages 34 are disposed head-to-tail and upside-down relative to the those of the passages 10 so that said members can interpenetrate, as shown in the figure.

Figure 7:
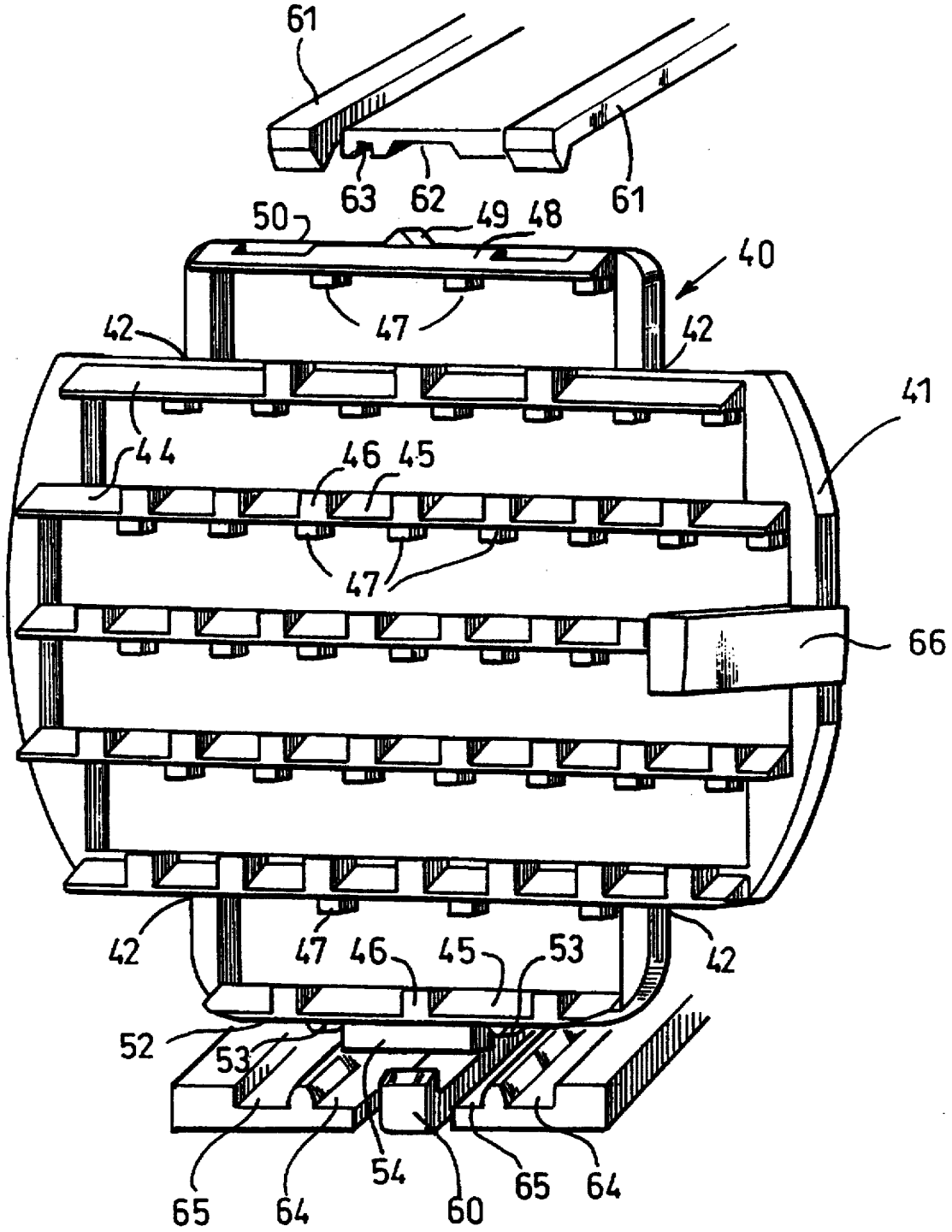
FIG. 7 is a perspective view of the key for locking the contact members in the female housing member.

A key 40 (see FIG. 7) mounts in the skirt 4. This key comprises a frame 41 with corners 42 corresponding to the ribs 30.

A series of strips 44 parallel to and in corresponding relationship to the passages 10 extend in the frame 41, each strip having bevels 45 on one side separated by abutments 46 and studs 47 on the opposite side.

The frame 41 has a crossmember 48 at one end which has a protuberance 49 partway along it and elongate notches 50 on either side of this protuberance.

At the end opposite the crossmember 48, the frame 41 has a second crossmember 52 the side of which facing towards the strips 44 features bevels 45 separated by abutments 46. On the free side there are two protuberances 53 with a boss 54 between them.

Figure 5:
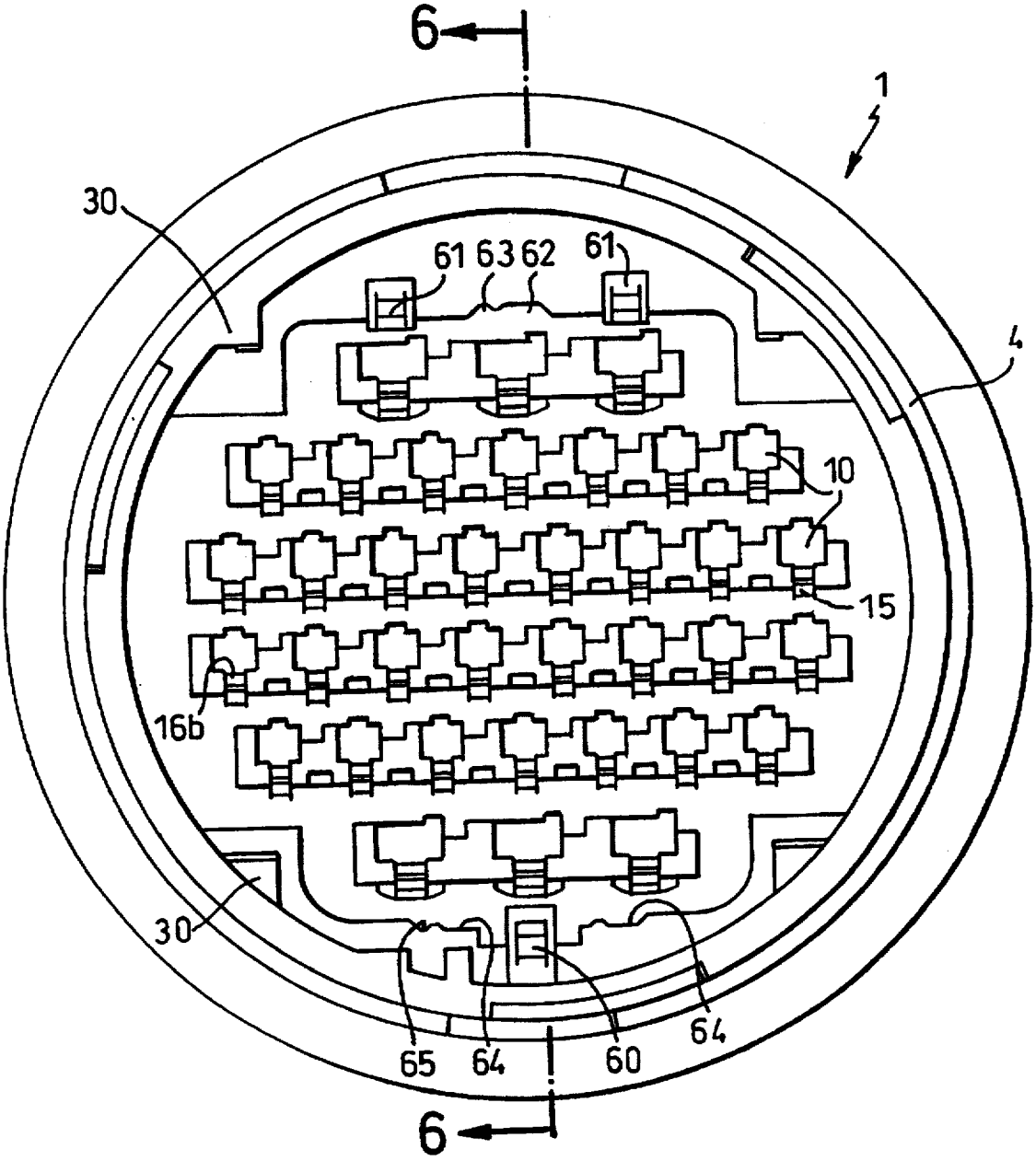
FIG. 5 is a plan view of the female housing member of the connector.
Figure 6:
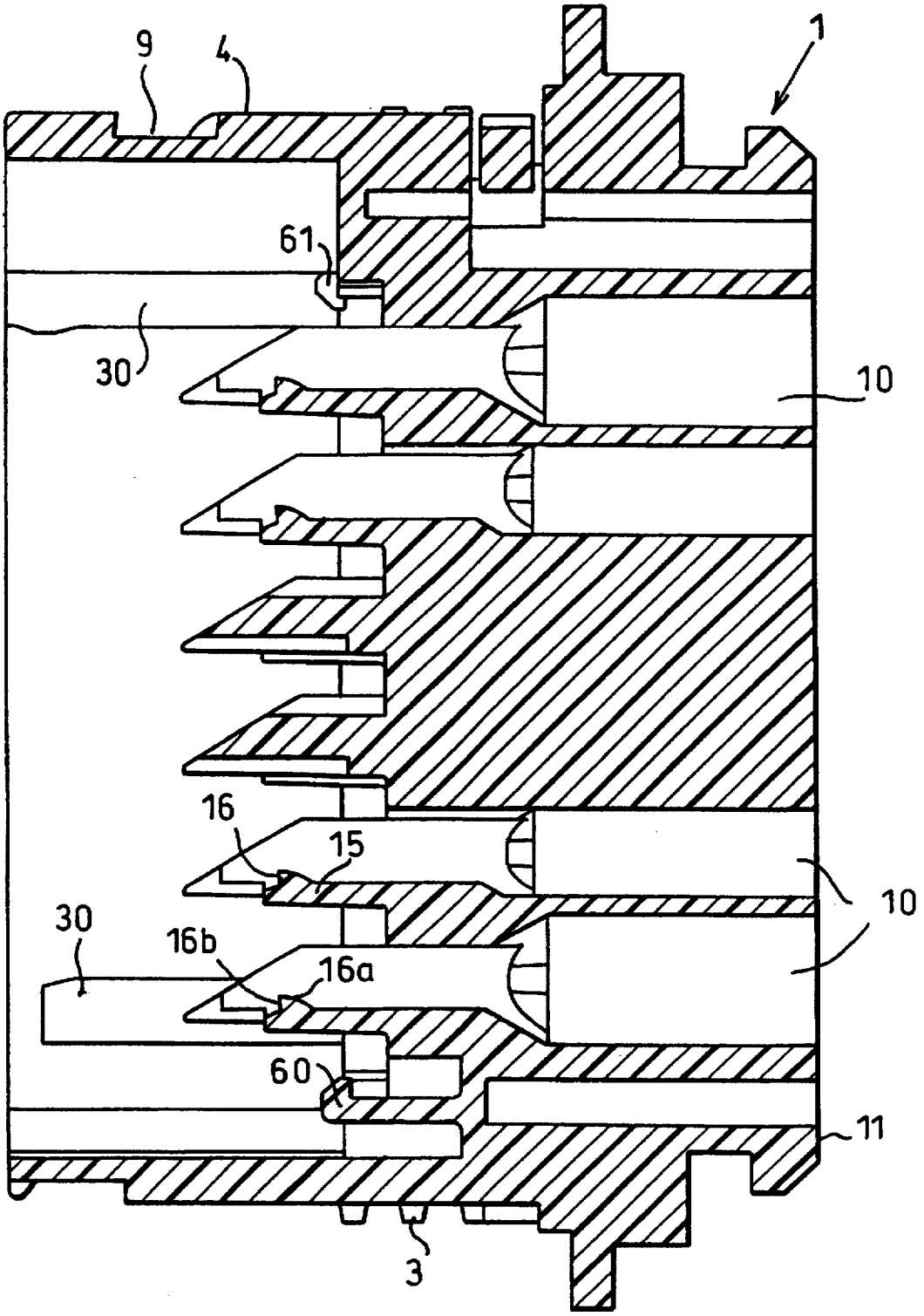
FIG. 6 is a view in section on the line 6—6 in FIG. 5.

The housing member 1 includes a hook 60 (see FIGS. 5 and 6) adapted to cooperate with the boss 54 and, diametrally opposite the hook 60, two hooks 61 adapted to cooperate with the elongate notches 50. Thus the key 40 can be fixed into the back of the member 1 simply by clipping it in place.

Two notches 62 and 63 between the hooks 61 are adapted selectively to receive the protuberance 49, the first defining a waiting position and the second a locking position.

Notches 64 and 65 on opposite sides of the hook 60 are adapted selectively to cooperate with the protuberances 53, the first defining a waiting position and the second a locking position.

The frame 41 has a strip 66 at one lateral end projecting from the side facing towards the male member 6.

Figure 16:
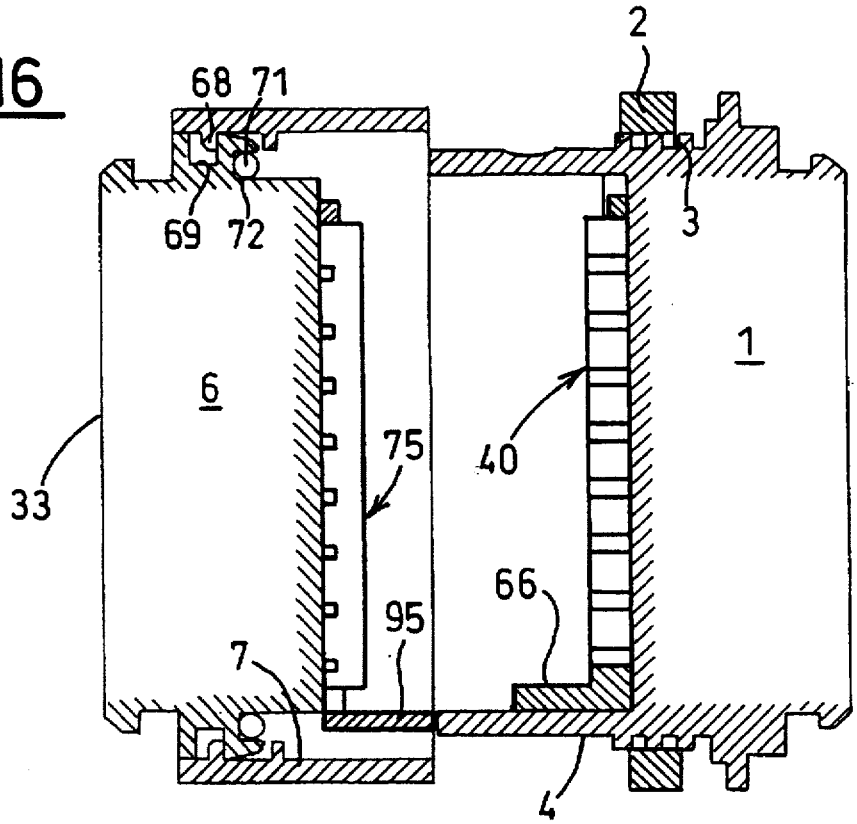
FIGS. 16 through 20 are diagrammatic sectional views showing how the two locking keys work.

The ring 7 includes cut-out lugs 67 with ribs 68 on their inside face adapted to cooperate with corresponding ribs 69 on the male member 1. Inside said ring is a shoulder 70, the male housing member 6 including a groove 72 in which the seal 71 is housed. When the connector components are assembled together, the free edge of the skirt 4 cooperates with said seal 71 (See FIGS. 1 and 16).

Figure 10:
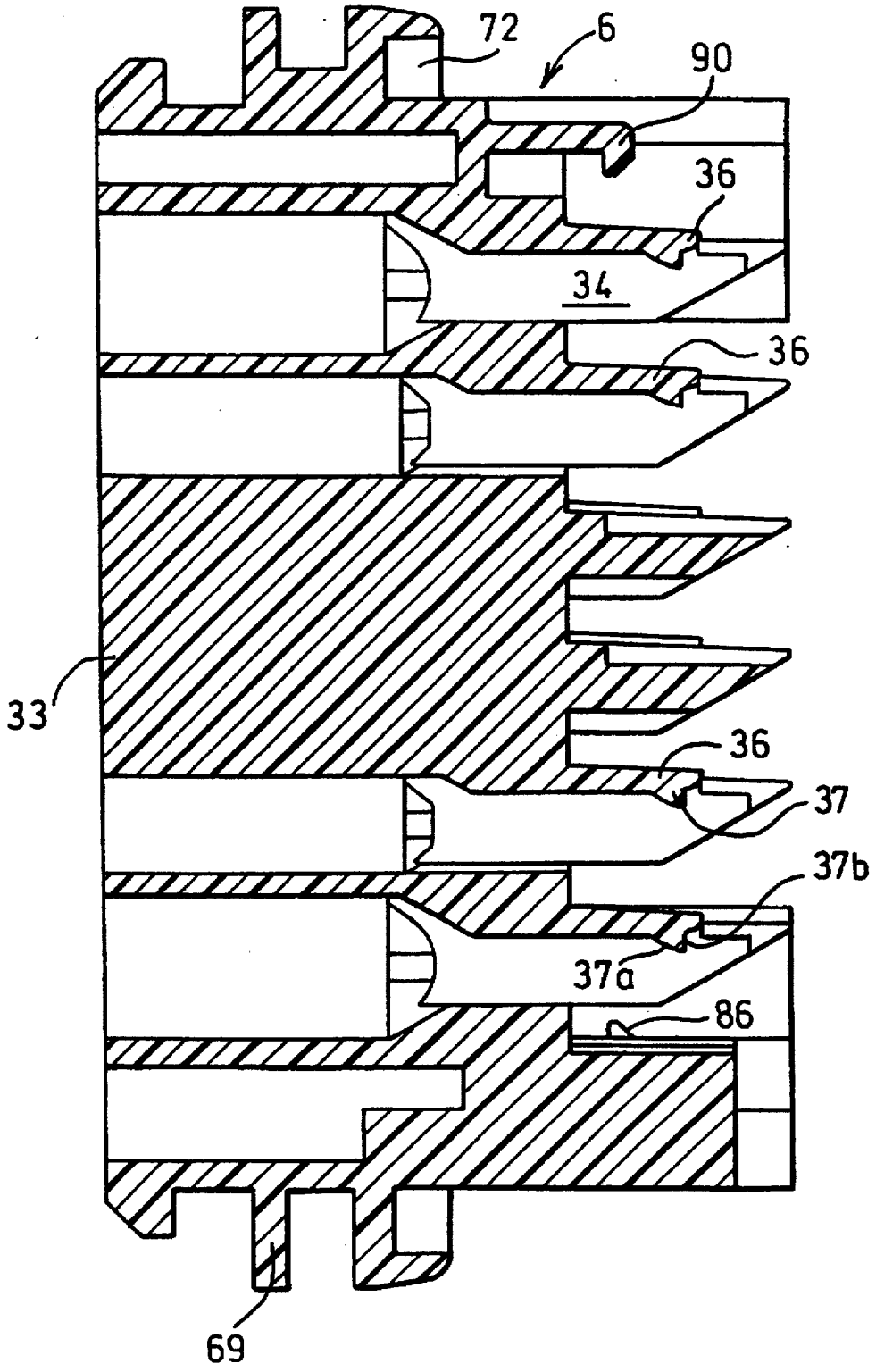
FIG. 10 is a view in section on the line 10—10 in FIG. 8.
Figure 11:
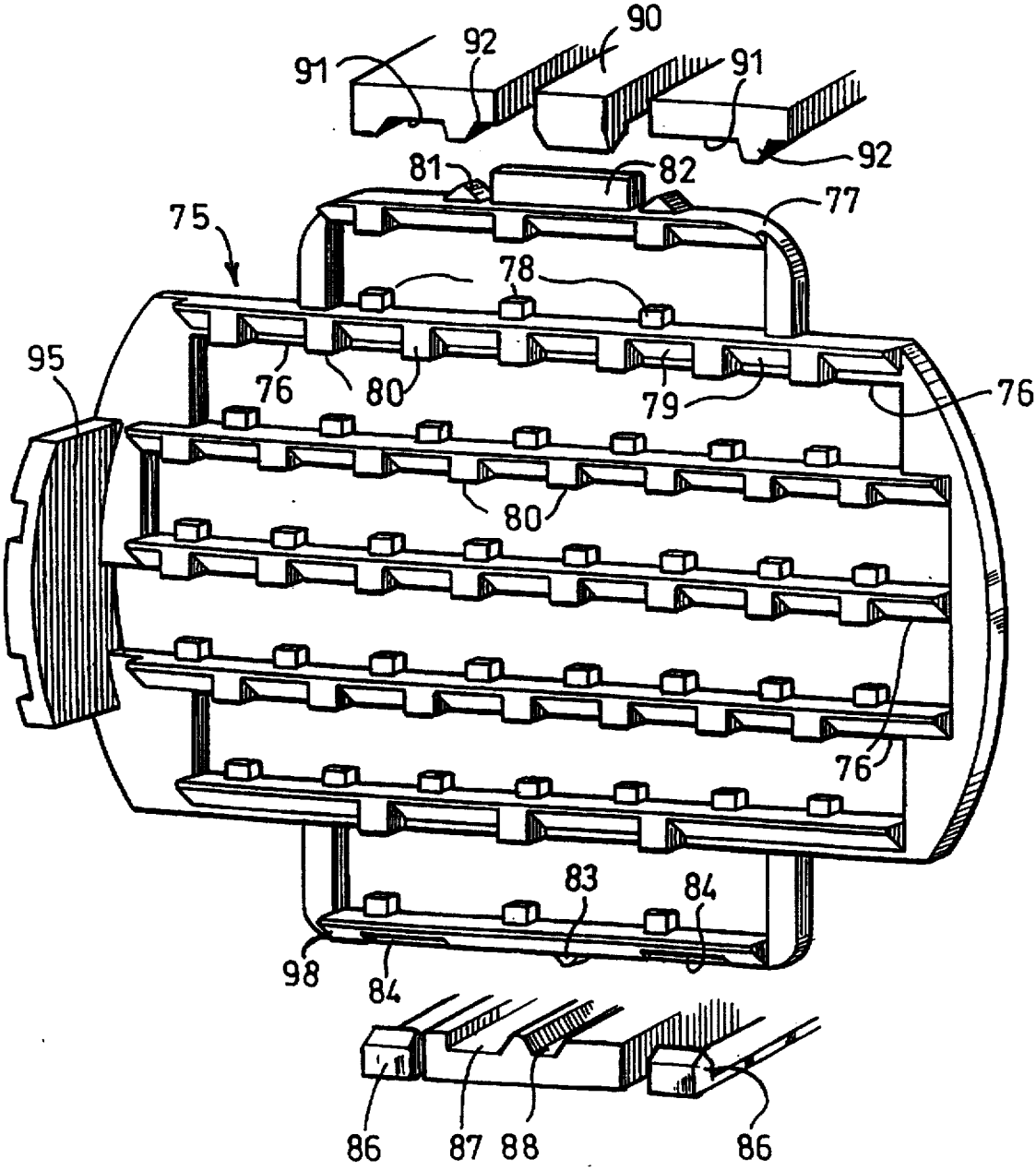
FIG. 11 is a perspective view of the key for locking the electric contact members in the male housing member.

FIG. 10 is a perspective view of the key for locking the members 20 into the passages 34 in the male housing member 6.

This locking key 75 is in the form of a frame within which is a series of parallel strips 76, one end of the key including a crossmember 77 and the other end including a crossmember 98.

The side of the strips 76 facing towards the crossmember 77 carries studs 78 and its opposite side carries bevels 79 separated by abutments 80.

The crossmember 77 includes two protuberances 81 with a boss 82 between them. The crossmember 98 has a protuberance 83 and two elongate notches 84.

The male housing member 6 has guide pillars 99 for the key 75 and two hooks 86 adapted to cooperate with the notches 84. Notches 87 and 88 between the hooks 86 are adapted selectively to receive the protuberance 83 (see FIGS. 8 and 9).

Diametrally opposite the hooks 86, the male housing member 6 has a hook 90 adapted to cooperate with the boss 82, notches 91 and 92 on either side of the hook selectively receiving the protuberances 81.

Thus the key 75 can occupy either of two positions, namely a waiting position in which the protuberances 81 are housed in the notches 91 and the protuberance 83 is housed in the notch 87, and a locking position in which the protuberances 81 are inserted into the notches 92 and the protuberance 83 is inserted into the notch 88.

The key 75 has a lateral strip 95 projecting from the side of the female housing member 1.

Figure 12:
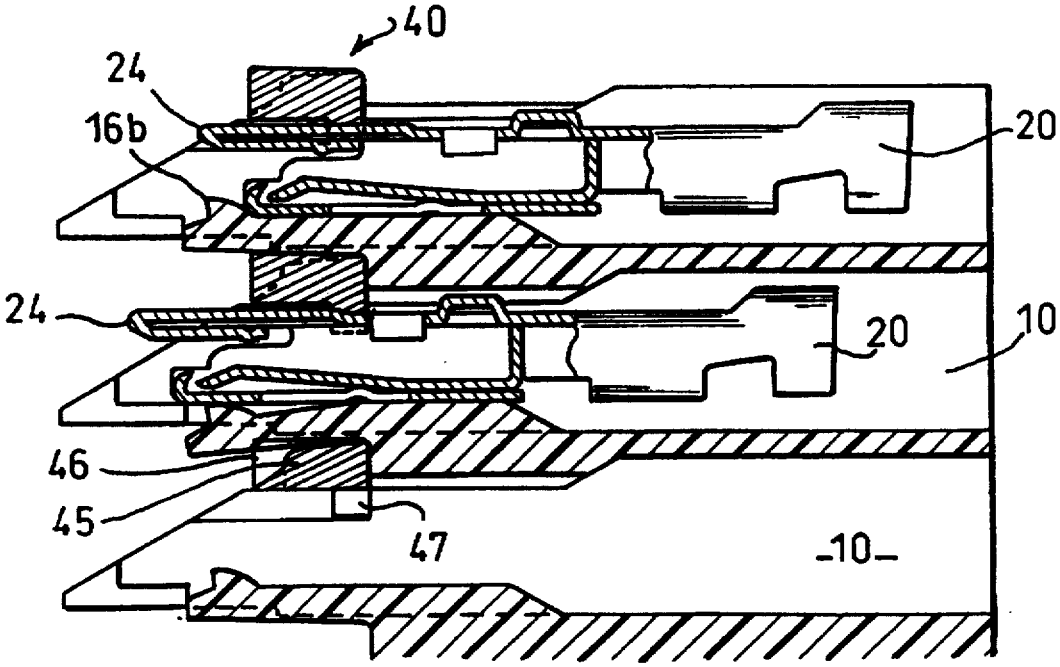
FIG. 12 is a sectional view to a larger scale showing the electric contact members inserted into the passages of the female housing member but not yet locked.

In the waiting position of the locking key 40, the strip 66 bears against the inside lateral surface of the skirt 4 and the bevels 45 are in line with the locking lugs 15; the latter can therefore move freely and retract elastically when a contact member is fitted, so that the corresponding projection is inserted in the opening 21 (see FIG. 12).

Figure 13:
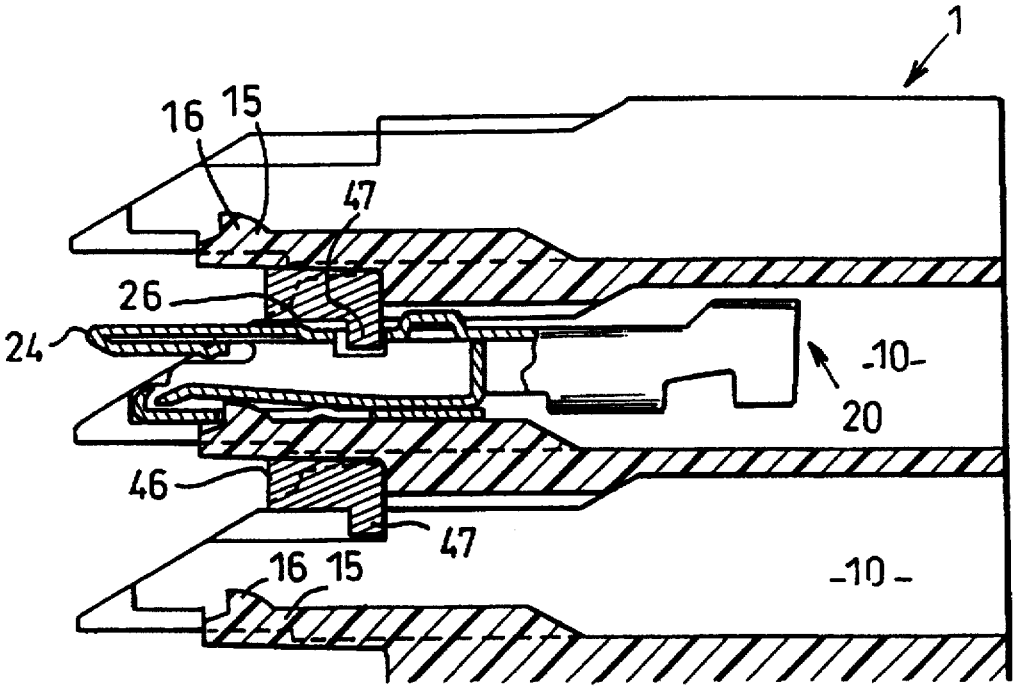
FIG. 13 is a view similar to FIG. 11 showing an electric contact member mounted in a passage of the female housing member and locked.

When the female member 1 has been fitted with the members 20 and the latter are in their correct places, the key 40 is pushed towards the locking position so that the protuberance 49 housed in the notch 62 and the protuberances 53 inserted in the notches 64 respectively locate in the notches 63 and 65. In this position (see FIG. 13), the abutments 46 are aligned with the locking lugs 15, and the latter are therefore immobilized. At the same time, the studs 47 are inserted in the lateral openings 26 of the members 20 so that the latter are locked in the passages and cannot inadvertently escape.

Figure 14:
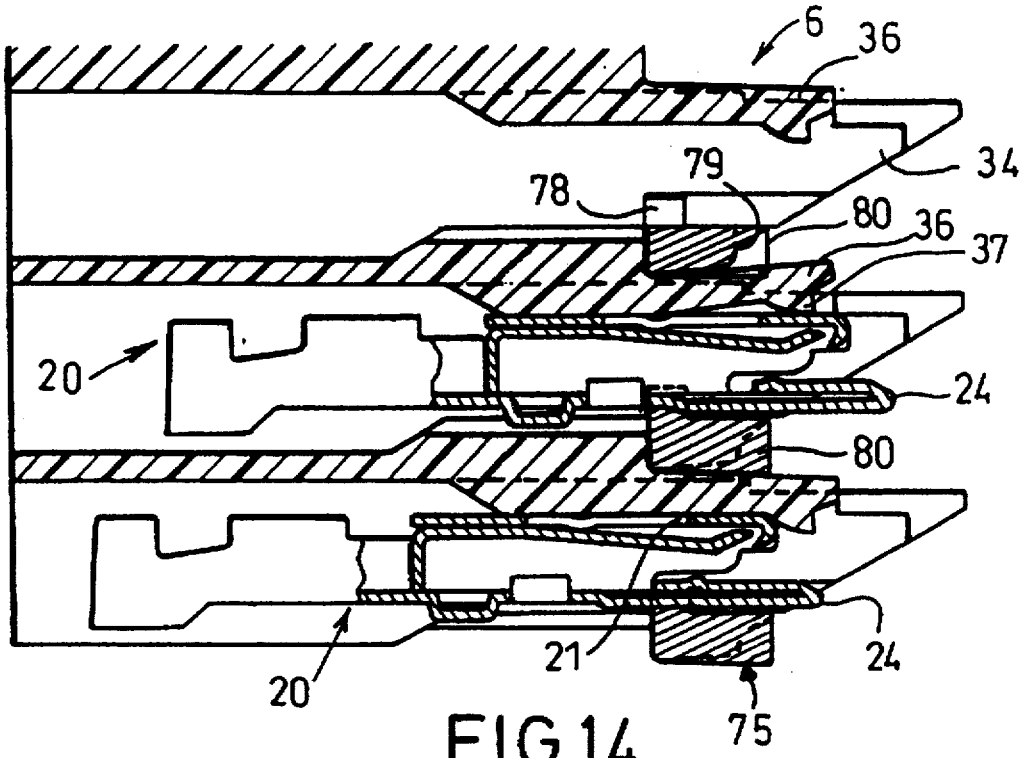
FIG. 14 is a sectional view showing the electric contact members inserted into the passages of the male housing member but not yet locked.
Figure 15:
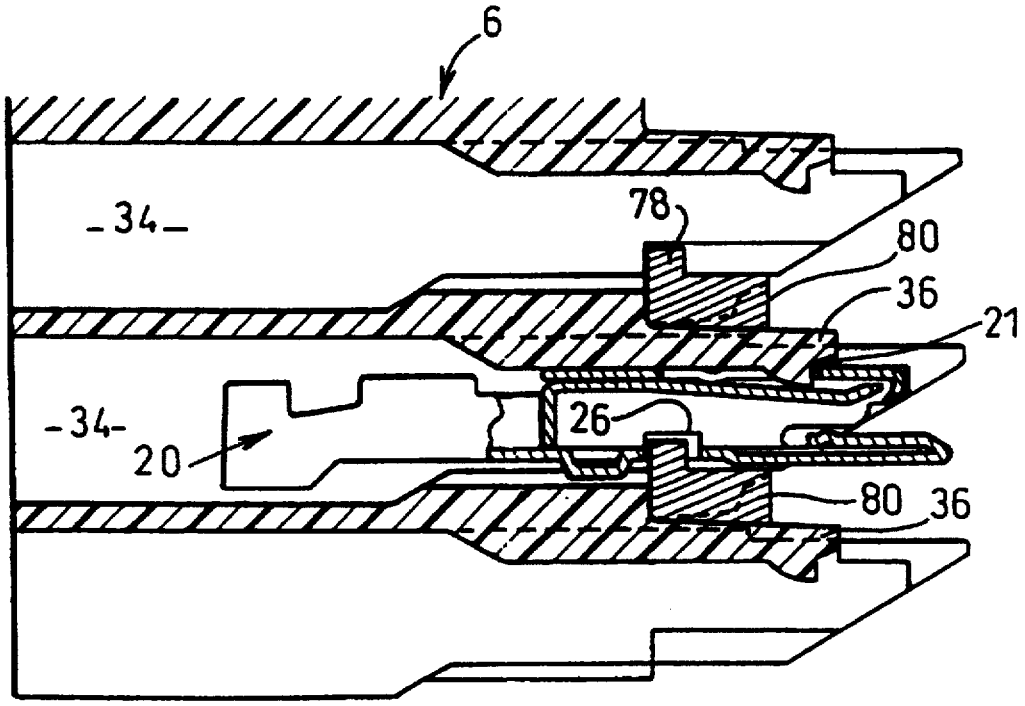
FIG. 15 is a sectional view similar to FIG. 14 showing the electric contact members when locked.

In the waiting position of the locking key (see FIG. 14), the bevels 79 are in line with the locking lugs 36 which can therefore separate elastically to allow insertion of the contact members 20 until the projections 36 are inserted in the opening 21, the lugs 36 then returning to their original position. The key can then be pushed into the locking position, the protuberances 81 moving from the notches 91 to the notches 92 and the protuberance 83 moving from the notch 87 to the notch 88. In this position the abutments 80 are in line with the locking lugs 36 and the studs 78 are inserted in the lateral openings 26 (see FIG. 15).

It will be realised that the keys 40 and 75 cannot be moved to the locking position if the members 20 are not correctly in place in the passages 10 and 34 since the studs 47 and 78 oppose sliding of the keys if the lateral opening 26 are not in the correct position since they abut against the lateral wall of the contact members.

FIGS. 16 through 20 also show that the housing members 1 and 6 cannot be assembled together if the keys 40 and 75 are not in the locked position. If the key 75 is in the waiting position (see FIG. 16), the lateral strip 95 abuts against the free edge of the skirt 4 and the male housing member 6 cannot be mounted in said skirt 4.

Figure 17:
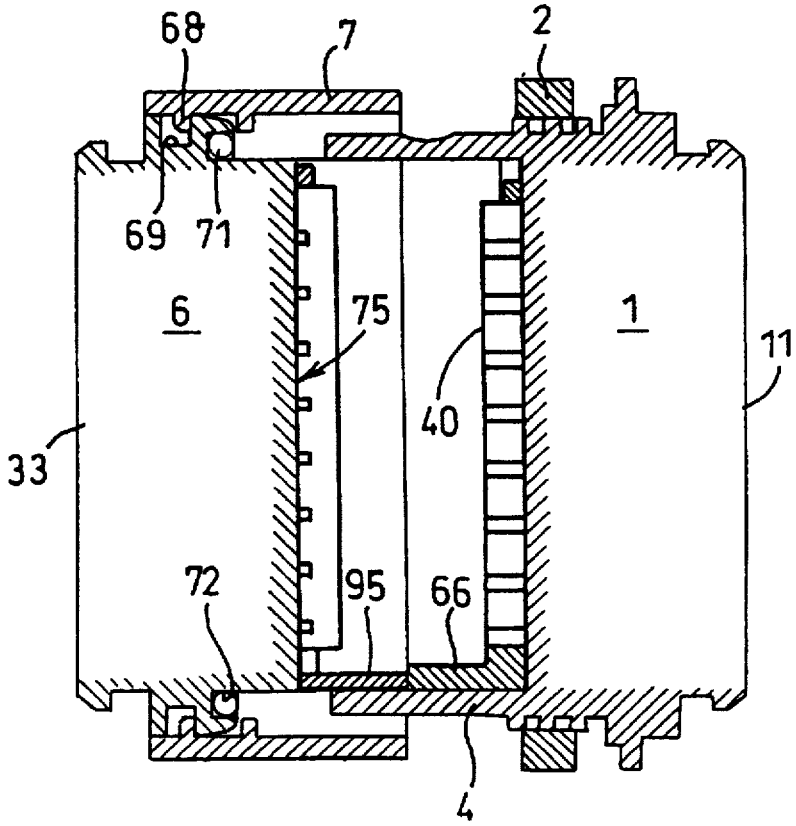

If the key 75 is in the locked position but the key 40 is in the waiting position, the strip 95 abuts against the free end of the strip 66 and the male housing member cannot be engaged in the skirt 4 (see FIG. 17).

Figure 18:
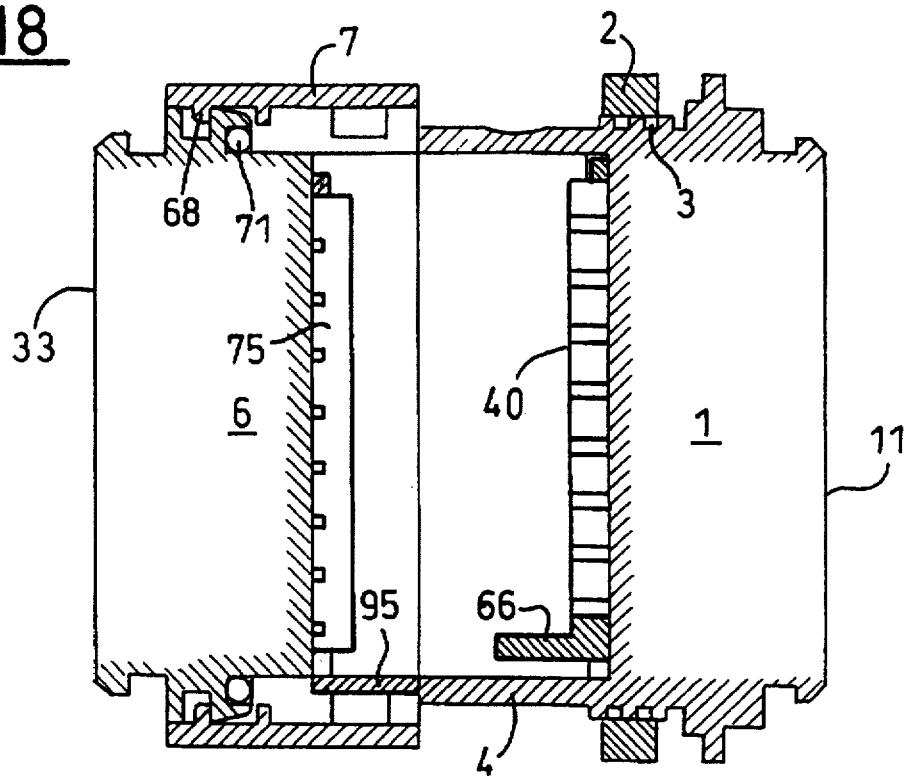

If the key 40 is in the locked position but the key 75 is in the waiting position, the strip 95 abuts against the skirt 4 and the housing members 1 and 6 cannot be assembled together (see FIG. 18).

Figure 19:
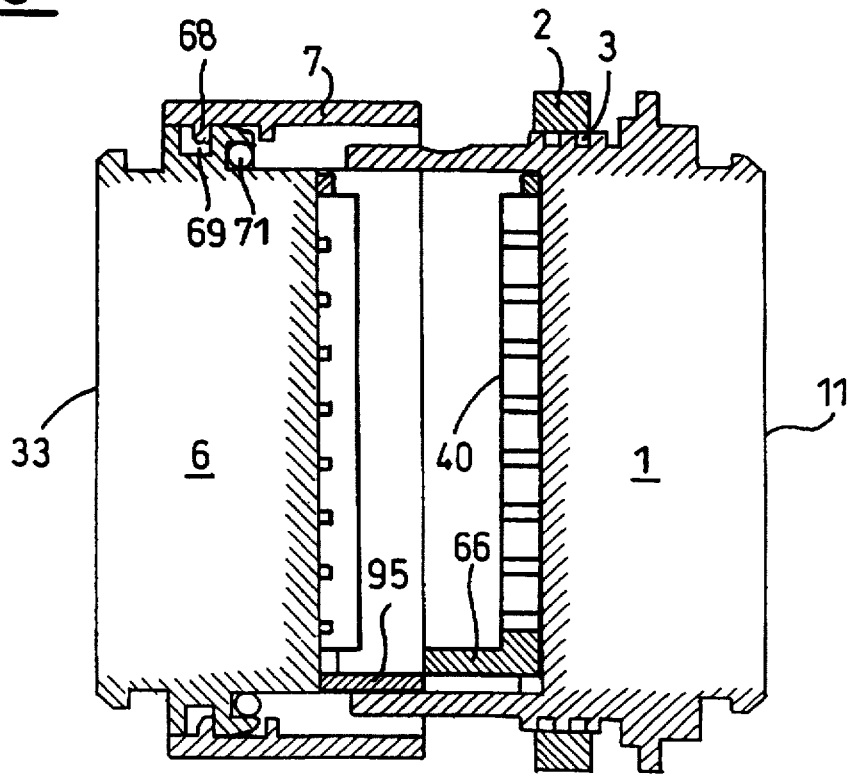
Figure 20:
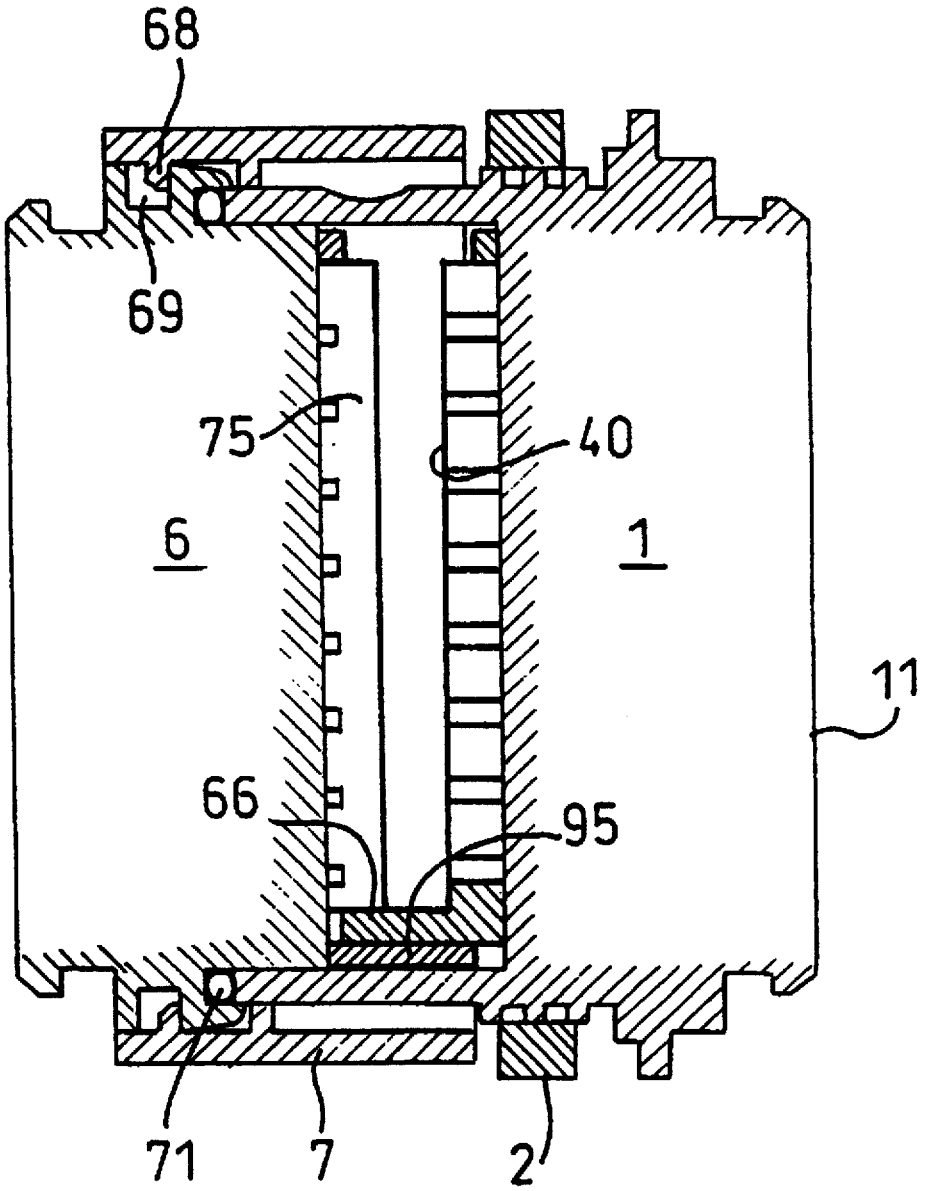

On the other hand, as shown in FIGS. 19 and 20, if the two keys 40 and 75 are in the locked position, the strip 95 is disposed along and inside the skirt and the strip 66 slides against the inside face of the lateral strip 95 until its free end engages in the corresponding opening between the two strips 76.

In this position (FIG. 20) the lugs 8 are inserted in the ramps 9 and the coupling ring 7 is turned to move said lugs to the ends of the ramps. The action of the coupling ring 7 obliges the male tongues 24 of the contact members 20 housed in the passages 34 to be inserted between the male tongues 24 and the elastic tongues 28 of the contact members 20 accommodated in the passages 10.

Of course, the invention is not limited to the embodiment just described and shown. Many modifications of detail may be made thereto without departing from the scope of the invention.

There is claimed:

1. An electrical connector comprising a female housing member including a series of passages each adapted to receive an electric contact member, a male housing member adapted to be inserted in said female housing member and including a series of passages, each adapted to receive an electric contact member and being complementary to those of said female housing member, means for assembling said housing members together, each housing member having, in each passage, an elastic locking lug featuring a projection adapted to cooperate with an opening in the corresponding electric contact member and each housing member including means for receiving, at an end of each housing member and adapted to cooperate with a corresponding end of the other housing member, a locking key mounted to slide perpendicularly to said passages and adapted to occupy a waiting position in which said elastic locking lugs move freely to enable mounting of electric contact members, and a locked position in which said locking key immobilizes said elastic locking lugs, each locking key including means for opposing insertion of said male housing member into said female housing member if the female housing member is in the waiting position, in which each locking key comprises a frame within which extends a series of parallel strips adapted to be inserted between said passages of said housing members transversely to said passages, said series of parallel strips having a face with bevels separated by abutments so that in said waiting position of said key, said bevels are in line with said locking lugs to enable the latter to move freely, whereas in said locking position said abutments are in line with said locking lugs to lock said locking lugs.

2. The electrical connector according to claim 1 wherein each locking key of one housing member includes a strip projecting towards the other housing member, said strip being disposed so that in said locking position of said keys they slide against each other.

3. Electrical connector according to claim 2, wherein when said strip of said locking key of said male housing member is in said waiting position of said key, said strip of said male housing member abuts against the free end of said female housing member, whereas when said strip of said male member is in said locked position and said locking key of said female housing member is in said waiting position, said strip of said male member abuts against the free end of said strip of said locking key of said female housing member.

4. The electrical connector according to claim 1 wherein each housing member includes hooks for fixing corresponding locking keys, said corresponding locking keys being mounted to slide between said hooks and including, on two opposite sides, protuberances adapted to cooperate selectively with pairs of notches in order to be retained in said two positions.

5. The electrical connector according to claim 1 wherein said electric contact members include a lateral opening and each locking key has lugs adapted to be inserted into each lateral opening in said locking position of said keys.

6. The electrical connector according to claim 1 wherein said lugs are disposed on a face of said strips opposite that provided with said bevels and said abutments and said lateral opening of said electrical contact members is on the side of a face opposite that with said opening adapted to receive said projection on said elastic locking finger.

7. An electrical connector according to claim 1, wherein said female housing member has means for fixing said female member into an opening in a wall, said electric contact members being hermaphroditic.

* * * * *